US009313583B2

(12) United States Patent
Rieger et al.

(10) Patent No.: US 9,313,583 B2
(45) Date of Patent: Apr. 12, 2016

(54) METHOD OF FITTING A BINAURAL HEARING AID SYSTEM

(71) Applicant: BERNAFON AG, Berne (CH)

(72) Inventors: Fritz Rieger, Berne (CH); Reinhard Winter, Berne (CH); Monika Bertges Reber, Berne (CH)

(73) Assignee: BERNAFON AG, Berne (CH)

( * ) Notice: Subject to any disclaimer, the term of this patent is extended or adjusted under 35 U.S.C. 154(b) by 467 days.

(21) Appl. No.: 13/779,477

(22) Filed: Feb. 27, 2013

(65) Prior Publication Data

US 2013/0223634 A1 Aug. 29, 2013

Related U.S. Application Data

(60) Provisional application No. 61/604,537, filed on Feb. 29, 2012.

(30) Foreign Application Priority Data

Feb. 29, 2012 (EP) ..... 12157413

(51) Int. Cl.
*H04R 25/00* (2006.01)

(52) U.S. Cl.
CPC ..... *H04R 25/50* (2013.01); *H04R 25/70* (2013.01); *H04R 2225/41* (2013.01)

(58) Field of Classification Search
CPC .... H04R 25/70; H04R 25/552; H04R 25/356; H04R 25/50; A61B 5/12; A61B 5/123; A61B 5/16; A61B 5/7264; G06F 19/327; G06F 19/3437
USPC ..... 381/23.1, 60, 312, 314; 600/559; 700/94
See application file for complete search history.

(56) References Cited

U.S. PATENT DOCUMENTS

| | | | | |
|---|---|---|---|---|
| 2008/0221719 | A1* | 9/2008 | Margolis et al. | 700/94 |
| 2008/0253595 | A1 | 10/2008 | Steinbuss | |
| 2011/0051942 | A1 | 3/2011 | Wilson | |
| 2013/0010972 | A1* | 1/2013 | Ma | 381/23.1 |
| 2015/0049876 | A1* | 2/2015 | Kim et al. | 381/60 |

FOREIGN PATENT DOCUMENTS

| | | | |
|---|---|---|---|
| EP | 1 653 775 | A1 | 5/2006 |
| EP | 1 983 801 | A2 | 10/2008 |
| WO | WO 2008/109491 | A1 | 9/2008 |

OTHER PUBLICATIONS

European Search Report, dated Jul. 2, 2012, issued in European Patent Application 12 15 7413.1.

* cited by examiner

*Primary Examiner* — Davetta W Goins
*Assistant Examiner* — Phylesha Dabney
(74) *Attorney, Agent, or Firm* — Birch, Stewart, Kolasch & Birch, LLP

(57) ABSTRACT

A method fits a binaural hearing aid system for a person with a small or moderate asymmetrical hearing loss. The method comprises providing first hearing loss data for a right ear of a user; providing second hearing loss data for a left ear of a user; determining a difference between the first and second hearing loss data; classifying the degree of similarity of the first and second hearing loss data; determining basic hearing loss data to for each of the first and second hearing instruments depending on hearing loss classes; and calculating frequency dependent target gain values for each of the first and second hearing instruments.

25 Claims, 7 Drawing Sheets

METHOD OF FITTING A BINAURAL HEARING AID SYSTEM

This Non-Provisional application claims the benefit of U.S. Provisional Application No. 61/604,537 filed on Feb. 29, 2012 and to Patent Application No. 12157413.1 filed in Europe, on Feb. 29, 2012. The entire contents of all of the above applications are hereby incorporated by reference.

TECHNICAL FIELD

The present application relates to binaural fitting of hearing aids. The disclosure relates specifically to a method of fitting a binaural hearing aid system to a user. The application furthermore relates to a binaural hearing aid system, to a hearing aid fitting system and to a hearing aid system.

The disclosure may e.g. be useful in applications such as binaural hearing aid systems fitted to a user with an asymmetrical hearing loss.

BACKGROUND

The auditory system of a person with an asymmetrical hearing loss adapts over time to the asymmetry. If the person is supplied with a binaural fitting (a hearing instrument on each ear) the standard fitting process will try to optimize the hearing of both ears independently. From an objective point of view, this may be the correct way, but due to the long term adaptation the auditory system will perceive the acoustic sensation to be asymmetrical.

Hearing impaired persons typically have a long term progression in their hearing deficit. Even normal hearing persons may perceive a different sound impression from left and right ear (due to minor hearing ability differences between the left and right ears). The human brain is used to receive different intensities or sound impression and "autocorrects" them. It is hence relevant to consider whether hearing aid users really benefit from hearing aids fully compensating their hearing disability independently on each ear (based on a monaural evaluation). Typically a fitting rationale for calculating appropriate frequency dependent gains from a user's (frequency dependent) hearing thresholds (audiogram) calculates only monaural ('per ear') gains, and assume that correction in case of a the binaural fitting boils down to a level adjustment to each independent calculation. The level adjustment provides that gains on both ears are reduced by a certain (identical) amount (e.g. between 0 and 5 dB). This means that a traditional fitting rationale (e.g. NAL-RP or NAL-NL2 (NAL=National Acoustic Laboratories, Australia))—in case of a binaural fitting—results in two independent fittings.

Generally the first time acceptance of hearing aids is low for various reasons. The aforementioned effect of asymmetrical hearing loss is amongst them. It is intended to reduce or avoid this effect.

WO2008109491A1 deals with an audiogram classification system including categories for configuration, severity, site of lesion and/or symmetry of an audiogram. A set of rules can be provided for selecting the categories, wherein the set of rules ignore one or more local irregularities on an audiogram.

SUMMARY

In the present disclosure it is proposed to integrate the hearing loss (HL) data of the two ears of a person into a binaural audiogram (one audiogram representing left AND right ears) as a base for any fitting rationale. Binaural audiograms only makes sense as long as the hearing losses of the left and right ears are within certain limits of each other ('reasonable similar'). If the differences are big ('asymmetric loss'), the fitting rationale should calculate gains individually for each ear based on two monaural audiograms.

Use of the proposed binaural audiogram only makes sense for binaural hearing aid fittings. The scheme does not require binaural hearing aid processing (exchange of data between the hearing instruments of the binaural fitting), but may benefit from such processing.

An object of the present application is to provide an alternative scheme for fitting a binaural hearing aid system for a person with a small or moderate asymmetrical hearing loss.

In an aspect, the present application describes an algorithm to calculate the target gain for a first fit of an asymmetrical hearing loss.

Objects of the application are achieved by the invention described in the accompanying claims and as described in the following.

A method:

The general aspects of the method (algorithm) can be described by the following steps:

- Provide hearing loss data for left and right ears, e.g. audiograms;
- Determine the similarity of the two audiograms;
- Classify the two audiograms based on their degree of similarity;
- Determine the resulting binaural audiogram(s) to be used in target gain calculations for the left and right hearing instruments based on the assigned class of similarity.

In an aspect of the present application, an object of the application is achieved by a method of fitting a binaural hearing aid system to a user, the binaural hearing aid system comprising first and second hearing instruments adapted for being located at or in the right and left ear, respectively, of a user, the first and second hearing instruments being adapted to apply a frequency dependent gain to an input signal according to a user's hearing impairment, and for presenting an enhanced output signal to the user. The method comprises, providing first hearing loss data for a right ear of a user;

- providing second hearing loss data for a left ear of a user;
- determining a hearing loss difference measure indicative of a difference between said first and second hearing loss data;
- classifying the degree of similarity of the first and second hearing loss data based on said hearing loss difference measure into at least two different hearing loss classes SIMILAR and DIFFERENT;
- determining basic hearing loss data to form the basis for calculating sets of frequency dependent target gain values for each of the first and second hearing instruments depending on said hearing loss classes, wherein said basic hearing loss data are identical for the first and second hearing instruments, if said hearing loss class is SIMILAR; and calculating the sets of frequency dependent target gain values for each of the first and second hearing instruments based on said basic hearing loss data.

An advantage of the method is that it may increase the first time acceptance of the hearing aid system compared to previous fitting schemes.

The hearing loss of (an ear of) a user at a particular frequency is defined as the deviation in hearing threshold from the hearing threshold of a normally hearing person. Hearing loss is typically graphically illustrated in an audiogram, where a user's hearing loss has been measured at a number of frequencies over the frequency range of interest (typically below 8 kHz).

An audiogram of an ear of a user shows the hearing loss (in dB HL) versus frequency (typically depicted on a logarithmic scale). In other words an audiogram illustrates the deviation from normal hearing in that it graphically depicts the hearing threshold at the ear in question minus the hearing threshold of a normal hearing person (in dB).

The term 'target gain' is intended to indicate a (frequency dependent) gain that ideally should be applied to an input signal of a hearing instrument for a specific ear of a given user (for whom the target gain values are specifically calculated, based on the user's hearing loss) to compensate for the user's hearing impairment. In a practical situation, this target gain value (sometimes termed the 'requested gain') may differ from the actually applied gain. This can have a variety of causes, e.g. risk of feedback (lowering the intended gain to avoid howl) or compression (attenuating the input signal for high level inputs) or noise reduction (gain may be suppressed to avoid amplifying (unwanted) noise). In other words the target gain may be 'overridden' on request of other algorithms (or sensors) having other foci than applying an appropriate gain for compensating the user's hearing impairment.

In an embodiment, the target gains of a particular hearing instrument are determined from the hearing loss (or corresponding hearing threshold) data using conventional hearing threshold based prescription rules. In an embodiment, the target gains of a particular hearing instrument are determined using a fitting algorithm, such as NAL-RP, NAL-NL2 (National Acoustic Laboratories, Australia), DSL (National Centre for Audiology, Ontario, Canada), ASA (American Seniors Association), VAC (Veterans Affairs Canada), etc., using hearing threshold or hearing loss data.

Typically, the fitting algorithm is executed on a separate processing device, e.g. a PC, having a communication interface (e.g. a programming interface, e.g. a wireless interface) to the binaural hearing aid system (e.g. to each of the hearing instruments) whereby the appropriate frequency dependent target gain for the hearing instrument in question is determined. The target gains may subsequently be transferred to the hearing instrument in question (e.g. via the programming interface). Alternatively, the hearing loss data may be transferred to the hearing instruments via the programming interface and the target gains may be determined in the hearing instruments (e.g. by executing a specific 'fitting algorithm' in the hearing instruments using the hearing loss data as inputs).

In an embodiment, the hearing loss data for each ear of the user are recorded based on measurement of the user's hearing threshold at a number $N_{HL}$ of predetermined frequencies.

In an embodiment, the hearing loss data to form the basis for calculating sets of frequency dependent target gain values for the two hearing instruments of a binaural hearing aid system by classifying the similarity of audiograms for the left and right ears of a user are based on air conduction hearing loss data ($AC_{HL}(f)$).

In an embodiment, a so-called bone conduction hearing threshold ($BC_{HL}(f)$) is determined for the left and right ears of the user.

In an embodiment, a conductive hearing loss (the 'air-bone gap', ABG(f)) is determined for the left and right ears of the user as the difference between the air conduction and bone conduction hearing thresholds ($ABG(f)=AC_{HL}(f)-BC_{HL}(f)$, [dB HL]).

In an embodiment the method comprises identifying audiograms exhibiting a conductive hearing loss smaller than a predefined value (e.g. represented by an ABG-measure, ABGM). In an embodiment, the ABG-measure for a given ear is a sum of $ABG(f_i)$-values, [dB HL], i=1, 2, . . . , $N_{HL}$, $N_{HL}$ being a number frequencies contributing to the ABG-measure, ABGM being smaller than a predefined value $ABGM_{pd}$). Preferably, cases that do not fulfill such criterion are handled separately (i.e. each ear is treated individually as recommended by today's fitting rationals), because such losses may have different causes that need different treatment.

In an embodiment, the hearing loss difference measure HLDM depends on the difference between the values of hearing losses of the first and second ears $HL_1(f)-HL_2(f)$ determined at a number $N_{HLDM}$ of frequencies.

The classification of the hearing loss difference between the right and left ears is used to determine the target gain values in the left and right hearing instruments. In an embodiment, classification of the hearing loss difference between the right and left ears is used to determine the time development of the gain values in the left and right hearing instruments from initial gain values to the target gain values (e.g. the modification algorithm). In an embodiment, a rate of change of initial gains towards target gains is controlled in dependence of the 'classification' of the hearing loss difference, e.g. slower the larger the difference.

In an embodiment, hearing loss data for each ear of a user are recorded (e.g. by an audiologist) based on measurement of the user's hearing threshold at a number ($N_{HL}$) of predetermined frequencies, e.g. at $f_1$=250 Hz, $f_2$=500 Hz, $f_3$=1 kHz, $f_4$=2 kHz, $f_5$=4 kHz, $f_6$=8 kHz (here $N_{HL}$=6). The hearing loss may be determined at a larger or smaller number $N_{HL}$ of frequencies than 6.

In an embodiment, $N_{HLDM}$ is equal to 1. In general, however, $N_{HLDM}$ is larger than 1. In an embodiment, $N_{HLDM}$ is equal to $N_{HL}$. In an embodiment, the hearing loss difference measure is determined as a sum of said differences, e.g.

$$HLDM_{SUM}=SUMi[|HL_1(f_i)-HL_2(f_i)|][\text{dB}],\ i=1-N_{HLDM},$$

where |x| denotes the absolute value of x, and $SUMi[x_i]$ denotes a summation of elements $x_i$ for all i.

Other hearing loss difference measures may be used depending on the application, e.g. a sum of hearing loss differences (without using the absolute value |x|), a sum of squares of hearing loss values, or a sum of squares of differences in hearing loss values.

In an embodiment, $N_{HL}$ and/or $N_{HLDM}$ are/is in the range from 2 to 10, e.g. equal to 5 or 8. In an embodiment, $f_1$=500 Hz, $f_2$=1 kHz, $f_3$=2 kHz, $f_4$=3 kHz, and $f_5$=4 kHz. In an embodiment, $f_1$=250 Hz, $f_2$=500 Hz, $f_3$=1 kHz, $f_4$=1.5 kHz, $f_5$=2 kHz, $f_6$=3 kHz, $1_7$=4 kHz, and $f_8$=6 kHz.

In an embodiment, a criterion for classifying the degree of similarity of the first and second hearing losses comprises that the hearing loss difference measure HLDM (e.g. $HLDM_{SUM}$) is within predefined limits.

In an embodiment, the number $N_{HLC}$ of hearing loss classes is two. In an embodiment, the number $N_{HLC}$ of hearing loss classes is three or more.

In an embodiment, the method comprises that the hearing loss classes comprise the classes, EQUAL, SIMILAR and DIFFERENT.

In an embodiment, the first and second hearing losses are defined as being EQUAL or SIMILAR if $HLDM_{SUM}$ is smaller than or equal to a first predefined threshold value $HLDM_{SUM,TH1}$ and DIFFERENT if $HLDM_{SUM}$ is larger than said first predefined threshold value $HLDM_{SUM,TH1}$.

In an embodiment, the first and second hearing losses are defined as being EQUAL if $HLDM_{SUM}$ is smaller than or equal to a first predefined threshold value $HLDM_{SUM,TH1}$ and DIFFERENT if $HLDM_{SUM}$ is larger than a second predefined threshold value $HLDM_{SUM,TH2}$ and SIMILAR if $HLDM_{SUM}$ is larger than the first predefined threshold value $HLDM_{SUM,TH1}$ but smaller than or equal to the second predefined threshold value $HLDM_{SUM,TH2}$.

In an embodiment, the first and second hearing losses are defined as being (EQUAL or) SIMILAR if $HLDM_{SUM}$ divided by the number of frequencies $N_{HLDM}$ at which hearing loss is measured and which contribute to the hearing loss difference measure $HLDM_{SUM}$ is smaller than or equal to a predefined value, e.g. 20 dB, i.e. $(HLDM_{SUM}/N_{HLDM})\leq 20$ dB. Other difference measures may be used, e.g. a difference between the average values $AVGi(HL_j)$ over frequency $i=1, 2, \ldots, N_{HLDM}$ $(j=1, 2)$, e.g. $|AVGi(HL_1)-AVGi(HL_2)|$ are smaller than predefined values, e.g.≤20 dB. In an embodiment, $AVGi(HL_j)$ is a weighted average.

In an embodiment, the first and second hearing losses are defined as being EQUAL if $(HLDM_{SUM}/N_{HLDM})$ is smaller than or equal to a first predefined value, e.g. ≤12 dB. In an embodiment, the first and second hearing losses are defined as being SIMILAR if $(HLDM_{SUM}/N_{HLDM})$ is larger than a first predefined value, but smaller than or equal to a second predefined value, e.g. 12 dB$<(HLDM_{SUM}/N_{HLDM})\leq 20$ dB.

In an embodiment, the first and second hearing losses are defined as being DIFFERENT if $(HLDM_{SUM}/N_{HLDM})$ is larger than a second predefined value, e.g. >20 dB.

In an embodiment, the criterion for classifying the degree of similarity of the first and second hearing losses comprises that the difference between the first and second hearing losses at one or more frequencies $f_i$, $i=1, 2, \ldots, N_{HLDM}$ is/are smaller than (a) predefined threshold value(s) $HLD(f_i)_{TH}$.

In an embodiment, the first and second hearing losses are defined as being (EQUAL or) SIMILAR if no single hearing loss difference for any of the frequencies $N_{HLDM}$ at which hearing loss is measured and which contribute to the hearing loss difference measure $HLDM_{SUM}$ is more than 30 dB (i.e. $HLD(f_i)\leq 30$ dB for all $i=1, 2, \ldots, N_{HLDM}$).

In an embodiment, the first and second hearing losses are defined as being DIFFERENT if $HLD(f_i)>30$ dB for at least one $i=1, 2, \ldots, N_{HLDM}$.

In an embodiment, the first and second hearing losses are defined as being EQUAL if $HLD(f_i)\leq 20$ dB for all $i=1, 2, \ldots, N_{HLDM}$.

In an embodiment, the criterion for classifying the degree of similarity of the first and second hearing losses comprises that $HLDM_{SUM}$ is within predefined limits as well as that the difference between the first and second hearing losses at one or more frequencies $f_i$, $i=1, 2, \ldots, N_{HLDM}$ is/are smaller or larger than (a) predefined threshold value(s) $HLD(f_i)_{TH}$.

In an embodiment, different strategies for determining target gain values in the first and second hearing instruments are used for different hearing loss difference classifications. The term 'gain strategy' is here intended to mean the strategy for determining first and second (frequency dependent) target gains of the first and second hearing instruments based on the first and second (basic) hearing loss data.

In an embodiment, the basic hearing loss data are identical for the first and second hearing instruments, if said hearing loss class is EQUAL. In an embodiment, the first and second hearing losses being defined as being EQUAL results in applying the same target gains for fitting the first and second hearing instruments. In an embodiment, the better audiogram HL-value from both sides is used to determine the target gains (i.e. for both instruments) for hearing loss class EQUAL. Preferably, the basic hearing loss data for the hearing loss class EQUAL used in the calculation of target gain values in the first and second hearing instruments are determined as the value $MIN\{HL_1(f_i); HL_2(f_i)\}$, where MIN denotes the minimum function, $HL_1(f_i)$ and $HL_2(f_i)$ are the hearing loss values at the $i^{th}$ frequency $f_i$ for the first (right) and second (left) ears, respectively, of the user, and $i=1, 2, \ldots, N_{HL}$. A binaural audiogram for hearing loss class EQUAL based on these hearing loss data may thus be generated.

In an embodiment, the first and second hearing losses being defined as being SIMILAR results in applying the same target gains for fitting the first and second hearing instruments. In an embodiment, the better audiogram HL-value from both sides is used plus ⅓ of the difference between the hearing loss values of the respective ears to determine the target gains for the hearing loss class SIMILAR. Preferably, the basic hearing loss data for the hearing loss class SIMILAR used in the calculation of target gain values in the first and second hearing instruments are determined as the value $MIN\{HL_1(f_i); HL_2(f_i)\}+(1/3)|HL_1(f_i)-HL_2(f_i)|$, where MIN denotes the minimum function, $HL_1(f_i)$ and $HL_2(f_i)$ are the hearing loss values at the $i^{th}$ frequency $f_i$ for the first (right) and second (left) ears, respectively, of the user, $i=1, 2, \ldots, N_{HL}$, and $|x|$ denotes the absolute value of x. A binaural audiogram for hearing loss class SIMILAR based on these hearing loss data may thus be generated.

In an embodiment, said basic hearing loss data are different for the first and second hearing instruments, if said hearing loss class is DIFFERENT. Preferably, the first and second hearing losses being defined as being DIFFERENT results in applying different target gains for fitting the first and second hearing instruments. In an embodiment, the hearing loss data for the hearing loss class DIFFERENT used in the calculation of target values in the first and second hearing instruments are the respective relevant hearing loss data $HL_1(f_i)$ and $HL_2(f_i)$, $i=1, 2, \ldots, N_{HL}$ for the first and second ears, respectively. Preferably, the audiogram HL-value from the respective sides are used to determine the target gains of the respective hearing instruments for hearing loss class DIFFERENT (i.e. for each instrument $HI_1$ and $HI_2$, the respective relevant hearing loss data $HL_1(f_i)$ and $HL_2(f_i)$, $i=1, 2, \ldots, N_{HL}$, are used to determine a target gain for the instrument in question), thus leading to different target gains for the first and second hearing instruments.

In an embodiment, the method comprises the step of storing the sets of frequency dependent target gain values, or gain values originating therefrom, for each of the first and second hearing instruments in respective memory units.

In an embodiment, the method comprises storing sets of basic gain values (e.g. equal to the target gain values or to modified target gain values) reflecting the user's hearing impairment. In each of the first and second hearing instruments current gain values may—at a specific time (during normal operation of the hearing instruments)—be determined from the stored basic gain values, but adapted to given acoustic environment conditions, e.g. based on one or more processing algorithms (e.g. noise reduction, compression, feedback, etc.).

In an embodiment, the first and second sets of stored basic gain values are equal to said sets of first and second frequency dependent target gain values, respectively. In an embodiment, the first and second sets of stored basic gain values are equal to said sets of first and second frequency dependent target gain values, respectively modified (e.g. diminished) with predefined amounts.

In an embodiment, the first and second sets of stored basic gain values are modified over a period of time (during normal operation of the hearing instruments) from initial values towards the target gain values. In an embodiment, the first and second sets of stored basic gain values are modified over a period of time according to a specific modification algorithm.

This may be advantageous for a first time user of the binaural hearing aid system. In an embodiment, the frequency dependent gains applied in the first and second hearing instruments are increased (e.g. in predetermined steps) over a period of time (e.g. months) from the initial gain values towards the target gain values determined according to the present disclosure. Thereby the (typical) way of slowly increasing the gains towards intended values is combined with the fitting procedure of the present disclosure (to allow a (first time) user to get accustomed to the system over a certain period of time).

A binaural hearing aid system:

In an aspect, a binaural hearing aid system comprising first and second hearing instruments adapted for being located at or in the right and left ear, respectively, of a user is furthermore provided by the present application. Each of the first and second hearing instruments comprises an input transducer for providing an electric input signal representing an audio signal; an output transducer for converting a processed electric signal to a stimulus perceivable as sound to the user;

a forward path being defined between the input and output transducers, the forward path comprising a signal processing unit being adapted to apply time and frequency dependent gain values to an input signal according to a user's hearing impairment;

a memory unit comprising a set of target gain values;

wherein said target gain values are determined by a method described above, in the 'detailed description of embodiments' and in the claims.

It is intended that the process features of the method described above, in the 'detailed description of embodiments' and in the claims can be combined with the system, when appropriately substituted by corresponding structural features and vice versa. Embodiments of the system have the same advantages as the corresponding method.

In an embodiment, the binaural hearing aid system comprises a programming interface to a hearing aid fitting system for exchanging data between said fitting system and the binaural hearing aid system. In an embodiment, the first and second hearing instruments of the binaural hearing aid system each comprises a programming interface to a hearing aid fitting system for exchanging data between said fitting system and the binaural hearing aid system.

In an embodiment, the target gain values are transferred to the memory units of the respective first and second hearing instruments of the binaural hearing aid system via said programming interface.

In an embodiment, the sets of frequency dependent target gain values for each of the first and second hearing instruments are stored in the respective memory units.

In an embodiment, the binaural hearing aid system is adapted to apply first and second sets of frequency dependent current gain values in each of the first and second hearing instruments, respectively.

In an embodiment, the binaural hearing aid system is adapted to use first and second sets of stored basic gain values of the first and second hearing instruments, respectively, as a basis for determining said first and second sets of current frequency dependent gain values, respectively.

In an embodiment, the first and second hearing instruments each comprises a timing unit for providing a timing control signal indicative of an elapsed time.

In an embodiment, the first and second sets of stored basic gain values are equal to said sets of first and second frequency dependent target gain values, respectively. In an embodiment, the first and second sets of stored basic gain values are equal to said sets of first and second frequency dependent target gain values, respectively modified (e.g. diminished) with predefined amounts.

In an embodiment, the binaural hearing aid system is adapted to modify the first and second sets of stored basic gain values over a period of time from initial values towards the target gain values. In an embodiment, the binaural hearing aid system is adapted to modify the first and second sets of stored basic gain values over a period of time according to a specific gain modification algorithm, e.g. executed in the signal processing unit.

In an embodiment, the binaural hearing aid system is adapted to provide that the gain modification algorithm provides modified gain values from initial gain values to target gain values depending on a timing control signal.

In an embodiment, the binaural hearing aid system is adapted to provide that said modified gain values are equal to said target gain values when said timing control signal is larger than a predefined end time value.

In a further aspect, the binaural hearing aid system comprises an auxiliary device.

In an embodiment, the system is adapted to establish a communication link between the hearing instrument and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing instrument.

In an embodiment, the auxiliary device is or comprises a remote control device for controlling operating parameters of the hearing instruments.

In an embodiment, the auxiliary device is or comprises a programming unit, e.g. for running a fitting software of the hearing instrument(s), for adapting the functionality (including processing parameters) of the hearing instrument(s) to the needs of a particular user.

The first and second hearing instruments of the binaural hearing aid systems may be largely identical in function, but be different in processing during operation, e.g. due to different gain profiles used in the signal processing units of the first and second hearing instruments.

General properties of each of the first and second hearing instruments are exemplified in the following (various aspects of digital hearing aids are described in [Schaub; 2008]):

The hearing instruments comprise an output transducer for converting an electric signal to a stimulus perceived by the user as an acoustic signal. In an embodiment, the output transducer comprises a number of electrodes of a cochlear implant or a vibrator of a bone conducting hearing device. In an embodiment, the output transducer comprises a receiver (speaker) for providing the stimulus as an acoustic signal to the user.

The hearing instruments comprise an input transducer for converting an input sound to an electric input signal. In an embodiment, the hearing instruments comprise a directional microphone system adapted to enhance a target acoustic source among a multitude of acoustic sources in the local environment of the user wearing the hearing instrument.

In an embodiment, the hearing instruments each comprise an antenna and transceiver circuitry for wirelessly receiving a direct electric input signal from another device, e.g. a communication device or another hearing instrument. In an embodiment, the direct electric input signal represents or comprises an audio signal and/or a control signal and/or an information signal.

The hearing instruments comprise a forward or signal path between an input transducer (microphone system and/or direct electric input (e.g. a wireless receiver)) and an output transducer. A signal processing unit is located in the forward path. The signal processing unit is adapted to provide a frequency dependent gain according to a user's particular needs. In an embodiment, the hearing instruments further comprise an analysis path comprising functional components for analyzing the input signal (e.g. determining a level, a modulation, a type of signal, an acoustic feedback estimate, a change of processing parameters, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing instruments comprise an analogue-to-digital (AD) converter to digitize an analogue input and provide a digitized electric input. In an embodiment, the hearing instruments comprise a digital-to-analogue (DA) converter to convert a digital signal to an analogue output signal, e.g. for being presented to a user via an output transducer.

In an embodiment, the hearing instruments each comprise an acoustic (and/or mechanical) feedback suppression system. In an embodiment, the hearing instruments further comprise other relevant functionality for the application in question, e.g. compression, noise reduction, etc.

A hearing aid fitting system:

A hearing aid fitting system comprising a processor and program code means for causing the processor to perform the steps of the method described above, in the 'detailed description of embodiments' and in the claims is furthermore provided by the present application. The hearing aid fitting system is particularly adapted for determining processing parameters (e.g. target gain values) for first and second hearing instruments of the binaural hearing aid system to a particular user.

The hearing aid fitting system preferably comprises a programming interface to the binaural hearing aid system, such as to a hearing instrument of the binaural hearing aid system, such as to each of the first and second hearing instruments of the binaural hearing aid system.

A hearing aid system:

A hearing aid system is furthermore provided by the present application. The hearing aid system comprises a binaural hearing aid system as described above, in the 'detailed description of embodiments' and in the claims AND a hearing aid fitting system for adapting processing parameters of the binaural hearing aid system to a particular user. The hearing aid system is particularly adapted for storing specifically determined processing parameters (e.g. target gain values) for a particular user in each of the first and second hearing instruments of the binaural hearing aid system.

Use of a binaural hearing aid system:

In an aspect, use of a binaural hearing aid system as described above, in the 'detailed description of embodiments' and in the claims is furthermore provided.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference numerals are used for identical or corresponding parts.

Figure 1A:
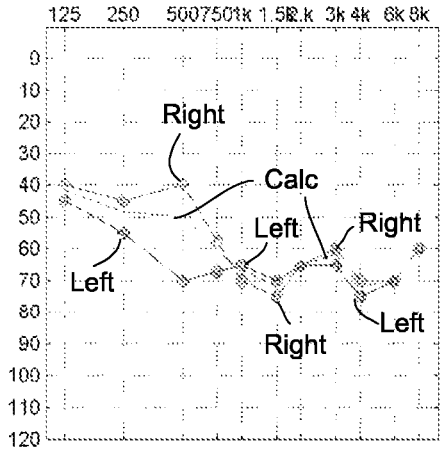
FIG. 1 shows hearing loss data [dB HL] (FIG. 1*a*) and resulting target gains [dB] for left (FIG. 1*b*) and right (FIG. 1*c*) hearing instruments of a user versus frequency [Hz], wherein the hearing loss data are classified as SIMILAR, FIG. 2 shows hearing loss data [dB HL] (FIG. 2*a*) and resulting target gains [dB] for left (FIG. 2*b*) and right (FIG. 2*c*) hearing instruments of a user versus frequency [Hz], wherein the hearing loss data are classified as EQUAL.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Hearing loss is typically graphically illustrated in an audiogram, where a user's hearing loss has been measured at a number of frequencies over the frequency range of interest (typically below 8 kHz).

The hearing loss (HL) of (an ear of) a user at a particular frequency is defined as the deviation in hearing threshold level (HTL) from the hearing threshold level of a normally ('norm') hearing person, in other words $HL_u(f)$ [dB HL]=$HTL_u(f)-HTL_{norm}(f)$ [dB SPL], f=frequency, 'u'='user', and 'norm'=normally hearing person. This relativity to 'normal data' is typically expressed by denoting the audiogram data in 'dB HL'.

In the following, the terms 'hearing loss' and 'hearing threshold' are used interchangeably and when used in an audiogram framework assumed to represent the same entity (provided in dB HL).

Hearing loss may be seen as a sum of contributions from so-called conductive losses in the outer and middle ear and from so-called sensorineural losses in the inner ear. The conductive losses may be due to external ear canal losses, losses of the eardrum or losses of the bones of the middle ear. Sensorineural losses may be due to damage or malfunction of the hair cells of the inner ear or the connections between the inner ear and the brain.

In a normal hearing test using an ear phone for playing soft sounds at different (pure tone) frequencies, the so-called air conduction hearing threshold ($AC_{HL}$) is determined (the sounds reach the ear drum and the middle and inner ear via sound vibrations in the air). Air conduction hearing loss ($AC_{HL}$) are indicated in the audiograms of FIGS. 1 to 3 by 'o'-symbols for left and right ears.

Similarly a so-called bone conduction hearing threshold ($BC_{HL}$) can be determined using a vibrator transmitting sound vibrations to the skull of the person, where the sounds thus reach the inner ear through the bones of the skull (bypassing the outer and middle ear). Bone conduction hearing loss ($BC_{HL}$) is indicated in the audiograms of FIGS. 1 to 3 by triangular symbols pointing left for left ears and right for right ears.

A conductive hearing loss (also termed the 'air-bone gap', ABG) can be determined as the difference between the air conduction and bone conduction hearing thresholds ($ABG=AC_{HL}-BC_{HL}$) in dB HL.

In an embodiment, the hearing loss data to form the basis for calculating sets of frequency dependent target gain values for the two hearing instruments of a binaural hearing aid system by classifying the similarity of audiograms for the left and right ears of a user are based on air conduction hearing loss data ($AC_{HL}(f)$).

The air conduction hearing threshold ($AC_{HL}$) is a composite measure of two different hearing loss contributions: a) the conductive part (ABG) and b) the sensorineural part. A hearing threshold for the sensorineural part may be represented by the bone conduction threshold ($BC_{HL}$). If the air conduction threshold $AC_{HL}$ is equal to the bone conduction threshold $BC_{HL}$, the conductive hearing loss is insignificant and a possible hearing loss is attributable to the inner ear and/or nerves to the brain, etc. (sensorineural hearing loss).

It may be advantageous to identify hearing loss data (e.g. audiograms) exhibiting a substantial conductive loss, i.e. having a significant air-bone gap as defined by an appropriate ABG-measure (e.g. a sum of $ABG(f_i)$-values, [dB HL], $i=1, 2, \ldots, N_{HL}$, being larger than a predefined value $ABG_{pd}$). Preferably such cases are handled separately (i.e. not according to the method of the present disclosure), because such losses may have different causes that need different treatment. In an embodiment the method of fitting a binaural hearing aid system to a user comprises identifying audiograms exhibiting a conductive hearing loss smaller than a predefined value (e.g. represented by an ABG-measure $ABG_{pd}$ that ensures that the conductive part of the hearing loss is insignificant).

There are different possibilities to measure similarity between (audiogram) data or curves ranging from simple differences between individual (curve) data to complex formula. In an embodiment, a rather simple approach is adopted by the introduction of a hearing loss difference measure (HLDM) with absolute differences and (possibly weighted) sums of such individual difference elements (e.g. taken at different frequencies, $HLDM_{SUM}=SUMi(w_i|HL_1(f_i)-HL_2(f_i)|)$, where $|HL_1(f_i)-HL_2(f_i)|$ is the absolute value of the difference between hearing loss values of the first and second ears at the frequency $w_i$ is a weight (e.g. between 0 and 1) of the $i^{th}$ term of the sum, $i=1, 2, \ldots, N_{HL}$., where $N_{HL}$ is a number of predetermined frequencies, contributing to the hearing loss difference measure). The multiplication with specific weights allows a control of the influence of specific frequency components on the calculated measure (HLDM). Setting a weight to zero for a given component excludes that component from the calculation. In an embodiment, all weights $w_i$ are equal to 1.

The following parameters are defined:

Air conduction hearing thresholds or hearing losses $$AC_{HL}(f_i)\ [dB\ HL],\ i=1, 2, \ldots, N_{HL}$$

Bone conduction hearing thresholds $$BC_{HL}(f_i)\ [dB\ HL],\ i=1, 2, \ldots, N_{HL}$$

Air bone gap $$AC_{HL}(f_i)-BC_{HL}(f_i)\ [dB\ HL],\ i=1, 2, \ldots, N_{HL}$$

A hearing loss difference measure may be based on one or more of the above parameters and relate to a single value (e.g. a maximum value at a single frequency at one ear or to a maximum difference value between the two ears at a single frequency) or to differences of values (at left and right ears), to a (possibly weighted) sum of values, to absolute values, to relative values, etc.

In the following 'hearing loss classes' and 'audiogram classes' are intended to have the same meaning. In an embodiment, the above mentioned special audiograms (e.g. having an air-bone gap measure larger than a predefined value) are identified in advance of the following classification and treated separately.

For the calculation of target gains of a binaural hearing aid system (e.g. for a first fitting), the following three hearing loss classes of asymmetry are used:

Audiograms are "EQUAL" (cf. FIG. 2)

Audiograms are "SIMILAR" (cf. FIG. 1)

Audiograms are "DIFFERENT" (cf. FIG. 3)

If the audiograms are graduated as SIMILAR and EQUAL on both sides, the same target gains are used in both hearing instruments.

If the audiograms are graduated as DIFFERENT, the target gains are different in the first and second hearing instruments (and there is no difference to the prior art fitting scheme).

Example RULES for the classification:

The audiograms are considered to be "EQUAL" if:

- Sum of differences for the frequencies 500 Hz, 1 kHz, 2 kHz, 3 kHz, 4 kHz is below or equal to 55 dB
- No single frequency difference for 250 Hz, 500 Hz, 1 kHz, 1.5 kHz, 2 kHz, 3 kHz, 4 kHz and 6 kHz is more than 20 dB Consequence: The target which is used for the fitting is the same for both sides.

For the calculation of the target gains a common hearing loss is calculated. Therefore the better audiogram HL-value from both sides is used, resulting in a binaural audiogram used for fitting both hearing instruments of the binaural hearing aid system.

The audiograms are considered to be "SIMILAR" if:

Sum of differences for the frequencies 500 Hz, 1 kHz, 2 kHz, 3 kHz, 4 kHz is below or equal to 90 dB No single frequency difference for 250 Hz, 500 Hz, 1 kHz, 1.5 kHz, 2 kHz, 3 kHz, 4 kHz and 6 kHz is more than 30 dB Consequence: The target which is used for the fitting is the same for both sides.

For the calculation of the target gains a common hearing loss is calculated. Therefore the better audiogram HL-value is used plus ⅓ of the difference between both values, resulting in a binaural audiogram used for fitting both hearing instruments of the binaural hearing aid system.

The audiograms are considered to be "DIFFERENT" if:

Sum of differences for the frequencies 500 Hz, 1 kHz, 2 kHz, 3 kHz, 4 kHz is larger than 90 dB At least one single frequency difference for 250 Hz, 500 Hz, 1 kHz, 1.5 kHz, 2 kHz, 3 kHz, 4 kHz and 6 kHz is more than 30 dB Consequence: The targets are calculated independently (as is usually done in the prior art).

With reference to FIGS. 1, 2 and 3, the bottom graphs (FIG. x.a , x.b, x=1, 2, 3), the graphs drawn in solid line represent target gains calculated according to the present disclosure (based on a binaural audiogram (FIGS. 1, 2)) and the graphs drawn in dashed line represent target gains calculated according the prior art (based on individual audiograms). Closely spaced solid and dashed line graphs corresponding to different levels of the input signal (50 dB, 65 dB and 80 dB, respectively) are indicated. In general, the graphs reflect that higher input signal level result in lower target gains.

Figure 1B:
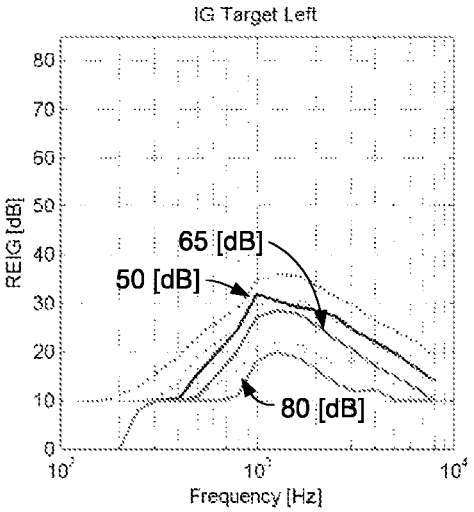
Figure 1C:
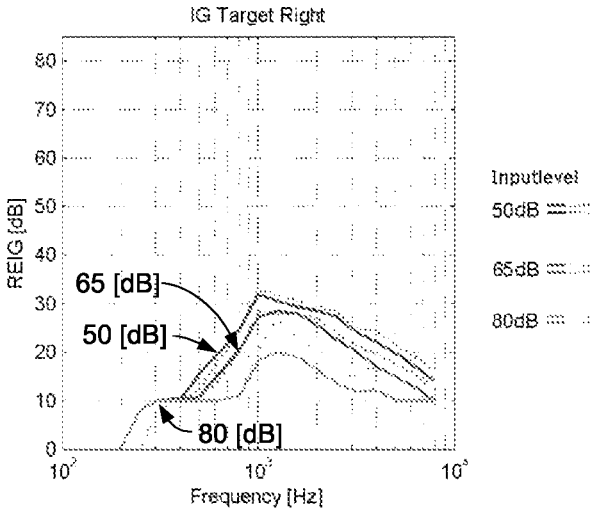

Hearing loss classification SIMILAR: FIG. 1 shows hearing loss data [dB HL] (FIG. 1*a*) and resulting target gains [dB] for left (FIG. 1*b*) and right (FIG. 1*c*) hearing instruments of a user versus frequency [Hz], wherein the hearing loss data are classified as SIMILAR. FIG. 1*a* shows two audiograms (denoted Right and Left) and the calculated audiogram (the binaural audiogram) common to both sides (denoted Calc). The solid graphs on FIG. 1*b* and 1*c* show the calculated target gain (REIG [dB]) vs. frequency (Frequency [Hz]) for each side (FIG. 1*b* showing the left, and FIG. 1*c* the right hearing instrument). The solid graphs are identical for the two instruments (based on a binaural audiogram). The dashed line graphs illustrate the target gain vs. frequency without a calculation according to the present disclosure (based on individual audiograms).

Figure 2A:
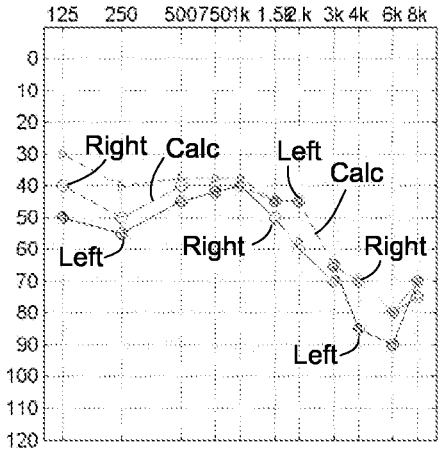
Figure 2B:
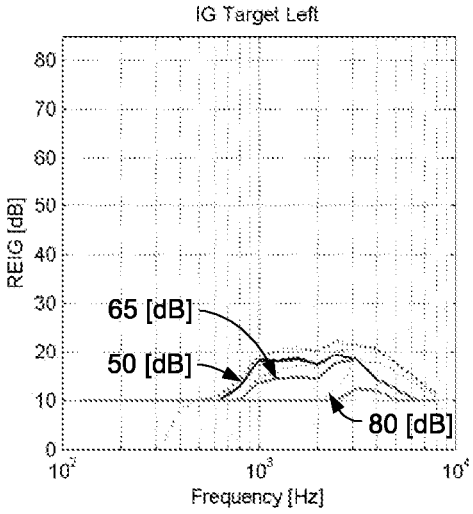
Figure 2C:
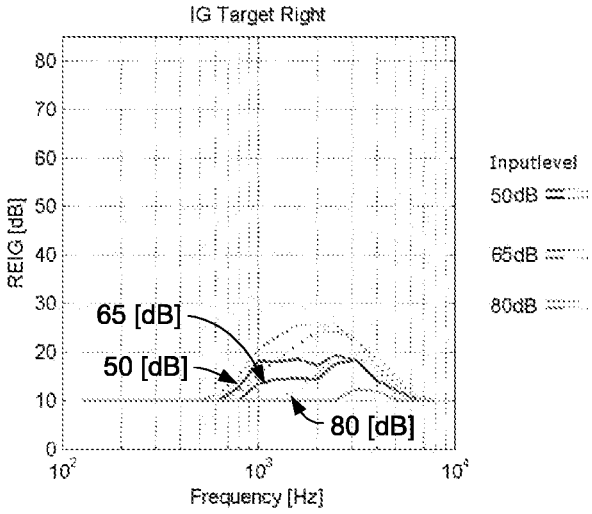

Hearing loss classification EQUAL: FIG. 2 shows hearing loss data [dB HL] (FIG. 2*a*) and resulting target gains [dB] for left (FIG. 2*b*) and right (FIG. 2*c*) hearing instruments of a user versus frequency [Hz], wherein the hearing loss data are classified as EQUAL. FIG. 2*a* shows two audiograms (denoted Right and Left) and the calculated audiogram (the binaural audiogram) common to both sides (denoted Calc). The solid graphs on FIGS. 2*b* and 2*c* show the calculated target gain (REIG [dB]) vs. frequency (Frequency [Hz]) for each side (FIG. 2*b* showing the left, and FIG. 2*c* the right hearing instrument). The solid graphs are identical for the two instruments. The dashed line graphs illustrate the target gain vs. frequency without a calculation according to the present disclosure (based on individual audiograms). The audiogram of FIG. 2*a* shows that the bone conduction hearing thresholds (right pointing triangular symbols) are different from (smaller than) the air conduction thresholds for the right ear at lower frequencies (below approximately 500 Hz) indicating a conductive hearing loss (in the outer and/or middle ear) at the right ear at these frequencies. In this case the difference is small enough to justify the application of the method of the present disclosure (to use the same 'binaural audiogram' for the fitting of both hearing instruments).

Figure 3A:
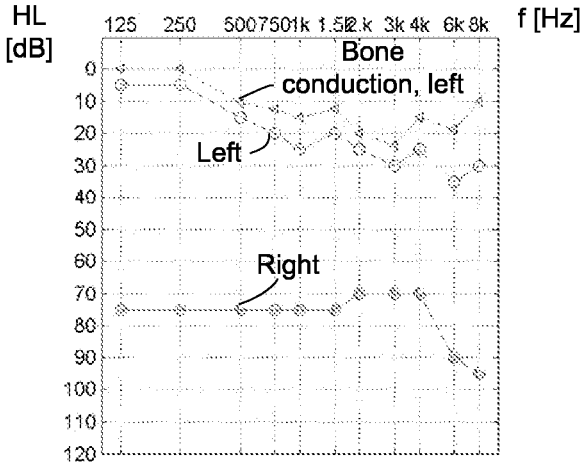
FIG. 3 shows hearing loss data [dB HL] (FIG. 3*a*) and resulting target gains [dB] for left (FIG. 3*b*) and right (FIG. 3*c*) hearing instruments of a user versus frequency [Hz], wherein the hearing loss data are classified as DIFFERENT.
Figure 3B:
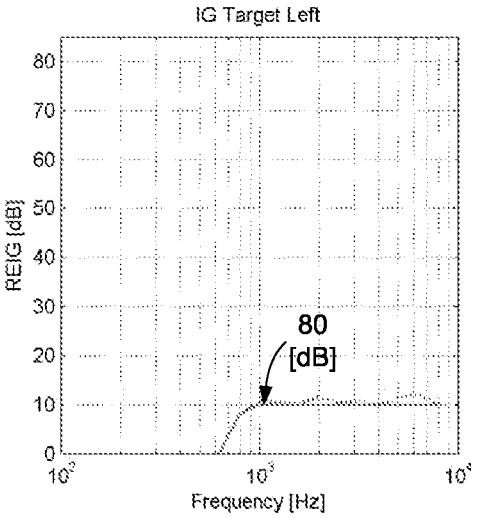
Figure 3C:
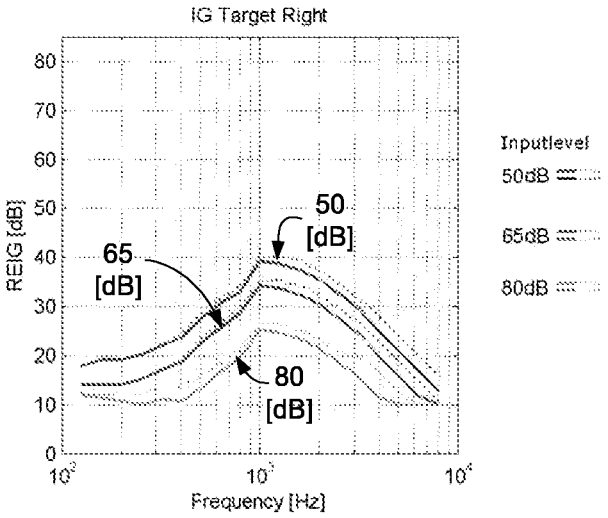

Hearing loss classification DIFFERENT: FIG. 3 shows hearing loss data [dB HL] (FIG. 3*a*) and resulting target gains [dB] for left (FIG. 3*b*) and right (FIG. 3*c*) hearing instruments of a user versus frequency [Hz], wherein the hearing loss data are classified as DIFFERENT. FIG. 3*a* shows two (quite different) audiograms (denoted Right and Left). The solid graphs on FIGS. 3*b* and 3*c* show the calculated target gain (REIG [dB]) vs. frequency (Frequency [Hz]) for each side (FIG. 3*b* showing the left, and FIG. 3*c* the right hearing instrument). The solid graphs are different for the two instruments. The dashed line graphs illustrate the target gain vs. frequency without a calculation according to the present disclosure (based on individual audiograms). In addition, the audiogram of FIG. 3*a* illustrates that the bone conduction hearing thresholds (left pointing triangular symbols) for the left ear (at all frequencies) are different from (smaller than) the air conduction thresholds indicating a conductive hearing loss (in the outer and/or middle ear) of the left ear. Thus for that reason alone, the present audiograms would not qualify for implementing the same 'binaural audiogram' to both ears as a basis for determining target gains for the two hearing instruments.

Figure 4:
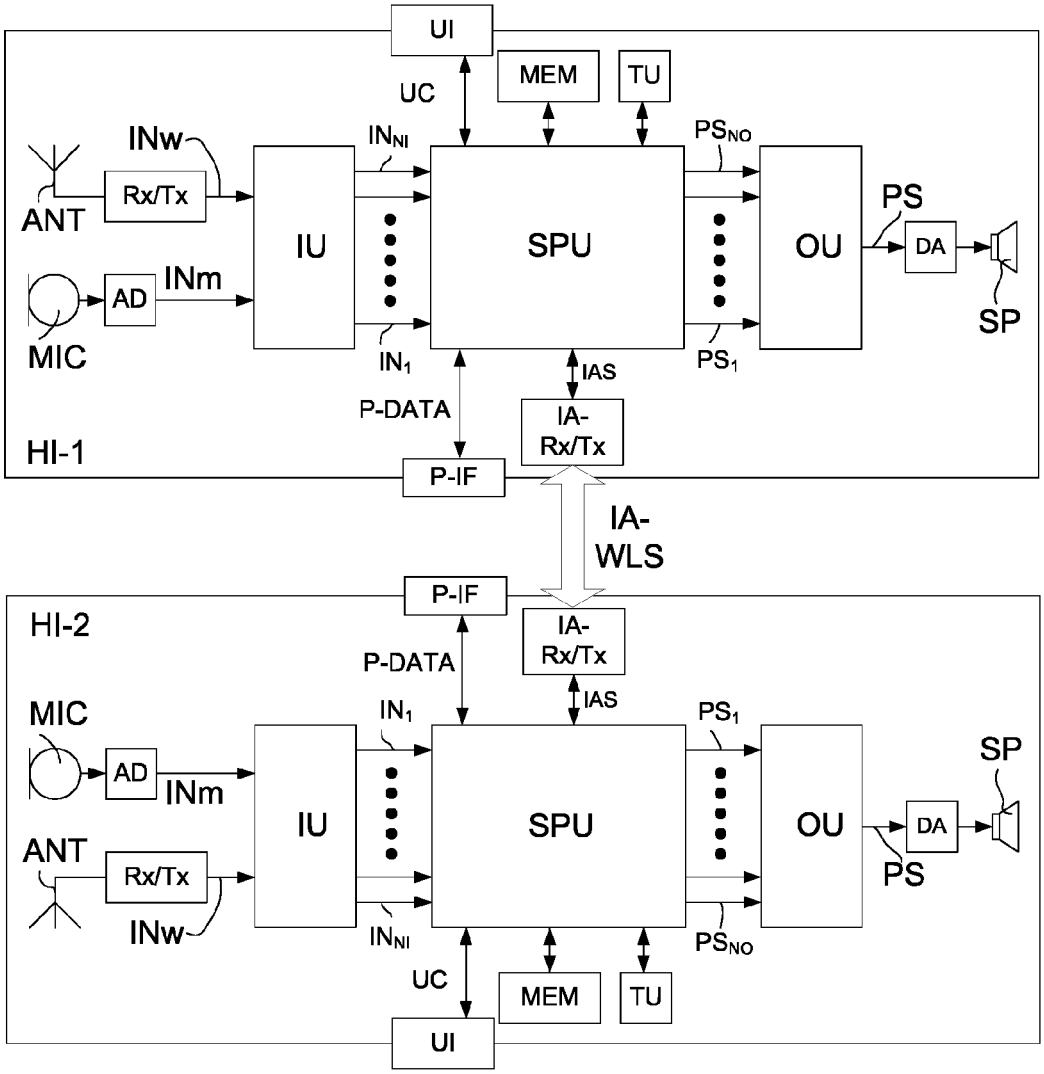
FIG. 4 shows an embodiment of a binaural hearing aid system comprising first and second hearing instruments.

FIG. 4 shows an embodiment of a binaural hearing aid system comprising first and second hearing instruments. The binaural hearing aid system comprises first and second hearing instruments (HI-1, HI-2) adapted for being located at or in left and right ears of a user. The hearing instruments are adapted for exchanging information (including control/status signals and/or audio signals) between them via a wireless communication link, e.g. a specific inter-aural (IA) wireless link (IA-WLS). The two hearing instruments HI-1, HI-2 are adapted to allow the exchange of status signals and/or audio signals (signal IAS). To establish the inter-aural link, each hearing instrument comprises antenna and transceiver circuitry (here indicated by block IA-Rx/Tx). Each hearing instrument further comprises a user interface (UI) and a programming interface (P-IF). The user interface (UI), e.g. an activation element (e.g. a button or selection wheel) in/on the hearing instrument or in/on a remote control, allows a user to influence the operation of the hearing instrument(s) and/or otherwise provide a user input (via signal UC to the signal processing unit SPU). The programming interface (P-IF) allows a hearing instrument to be connected to a programming unit (e.g. a fitting system, cf. e.g. FIT-SYS in FIG. 5) for adapting processing parameters of the hearing instruments HI-1 and HI-2 to be (individually) adapted to the user's needs (signal P-DATA to the signal processing unit SPU). Each hearing instrument (HI-1, HI-2) comprises a forward path from an input transducer (here microphone MIC and wireless receiver ANT, Rx/Tx) to an output transducer (here speaker SP). The forward path comprises a signal processing unit (SPU) for controlling the signal processing of the hearing instrument, including the application of a frequency dependent gain. In the embodiment of FIG. 4, the signal processing is performed fully or partially in the frequency domain. Therefore the forward path comprises analysis and synthesis filter banks (IU and OU, respectively) for converting a time domain signal (INm or INw, or a mixture thereof) to a frequency domain signal ($IN_1, IN_2, \ldots, IN_{NI}$) and for converting a frequency domain signal ($PS_1, PS_2, \ldots, PS_{NO}$) to a time domain signal (PS), respectively. NI and NO, denoting the number of input and output frequency bands, respectively, are preferably equal, e.g. equal to 8 or 16 or 32 or larger. The forward path comprises analogue to digital (AD) and digital to analogue converters (DA), as appropriate.

Each hearing instrument (HI-1, HI-2) comprises a memory (MEM) for storing basic processing parameters and/or data relating to a user's hearing impairment (e.g. hearing loss data) and/or basic (frequency dependent) gain values (e.g. the target gain values), from which current gain values appropriate in a given acoustic situation can be determined. The memory unit is operationally connected to the signal processing unit SPU allowing the signal processing unit to store and/or access data in the memory (MEM) as appropriate. In the embodiment of FIG. 4, each hearing instrument (HI-1, HI-2) further (optionally) comprises a timing unit (TU) for determining an elapsed time, e.g. from an initial point in time to a current time. The timing unit is operationally connected to the signal processing unit SPU allowing the signal processing unit to use a timing control signal provided by the timing unit as an input to a processing algorithm, e.g. a gain modification algorithm for modifying basic gain values stored in the memory unit based on the timing control signal.

One of the or both hearing instruments may in an embodiment comprise an oscillator (VCO, e.g. a voltage controlled oscillator, e.g. a voltage controlled crystal oscillator) for providing a sufficiently accurate timing input to the timing unit (TU) thereby allowing the timing unit to estimate an elapsed time with appropriate accuracy, e.g. in that the timing unit comprises a real time clock circuit and that an energy source of the hearing instrument ensures a constant functioning of the clock (even when the hearing instrument is not in use/powered down). Alternatively, the timing unit (TU) is adapted to receive a signal representative of the present time from another device, e.g. from a cell phone or from a radio time signal (e.g. DCF77 or MSF).

In an embodiment, the binaural hearing aid system further comprises an audio gateway device for receiving a number of audio signals and for transmitting at least one of the received audio signals to the hearing instruments (e.g. via wireless transceiver ANT, Rx/Tx providing audio input signal INw in FIG. 4). In an embodiment, the hearing aid system is adapted to provide that a telephone input signal can be received in the hearing instruments) via the audio gateway (and said wireless transceiver).

Figure 5:
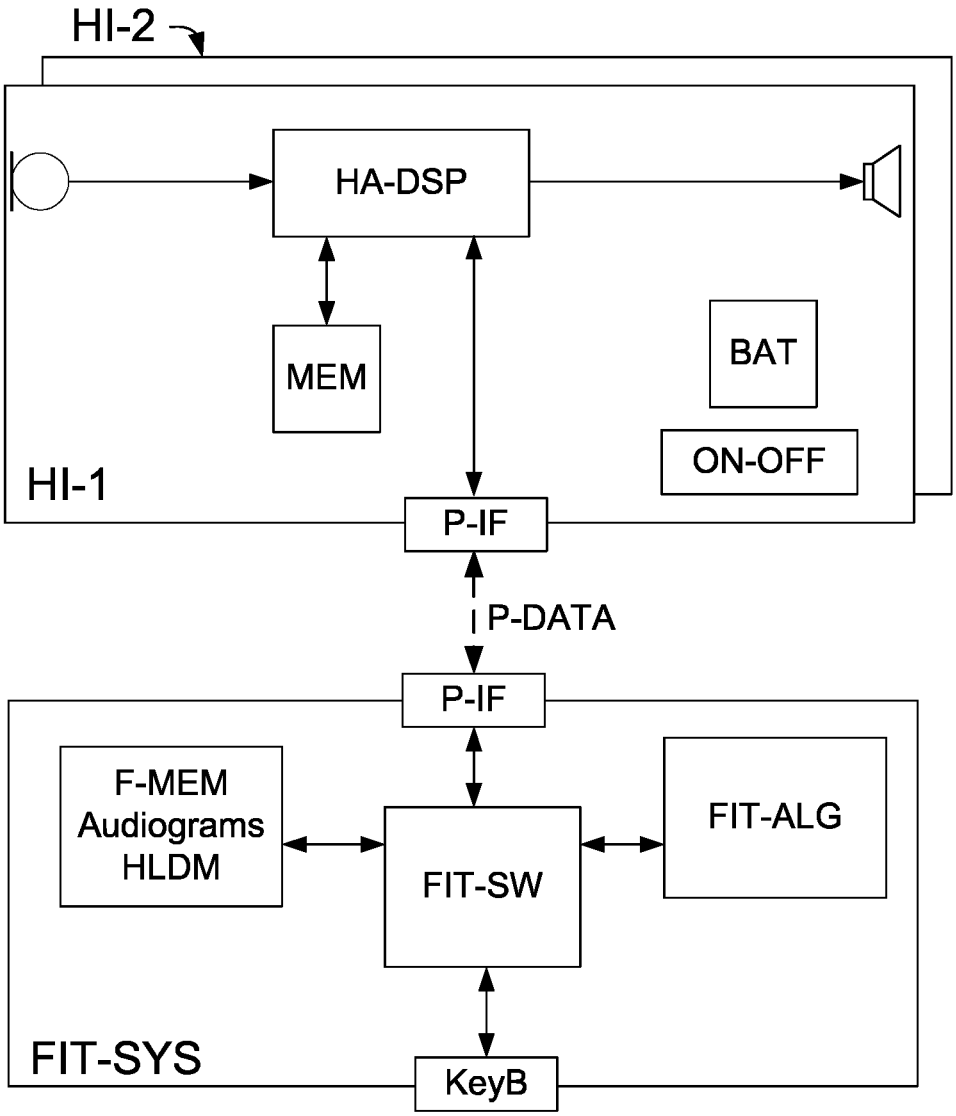
FIG. 5 shows a part of an embodiment of hearing aid system comprising a binaural hearing aid system and a programming device (fitting system)

FIG. 5 shows a part of an embodiment of hearing aid system comprising a binaural hearing aid system and a programming device (fitting system). The binaural hearing aid system comprising first and second hearing instruments (HI-1, HI-2) may e.g. be embodied as described in connection with FIG. 4. In the embodiment of FIG. 5, the forward path of a hearing instrument (HI-1, HI-2) is illustrated to comprise signal processing unit (HA-DSP), operationally connected to the input transducer (e.g. a microphone) and output transducer (e.g. a speaker). Each hearing instrument (HI-1, HI-2) comprises a memory unit (MEM) which is operationally connected to the signal processing unit (HA-DSP). Each hearing instrument (HI-1, HI-2) further comprises an energy source (BAT, e.g. a (e.g. rechargeable) battery). Each hearing instrument (HI-1, HI-2) may further comprise a user interface (ON-OFF, e.g. based on an activation element or a remote control). Each hearing instrument (HI-1, HI-2) further comprises an interface (IF) to a programming unit, e.g. a hearing aid fitting system (FIT-SYS), allowing data (P-DATA) to be transferred at least from the programming unit to the hearing instruments, and preferably also from the hearing instrument(s) to the programming unit. The programming unit (FIT-SYS) is adapted to run a fitting software (FIT-SW) and further comprises a memory unit F-MEM comprising hearing loss data for the user (e.g. hearing threshold data and/or audiogram data for the left and right ears of the user (Audiograms), hearing loss difference measures) (HLDM) determined from the hearing loss data, etc.). The hearing loss difference measure(s) (HLDM) are used to classify the hearing loss data of the left and right ears of the user according to their mutual difference. The fitting software is adapted to determine a binaural audiogram based on the hearing loss data of the left and right ears of the user to store such data in the memory F-MEM. The programming unit (FIT-SYS) further comprises a fitting algorithm (FIT-ALG) whose execution is controlled via the fitting software (FIT-SW). The fitting algorithm (FIT-ALG) uses the hearing threshold or audiogram data (e.g. the binaural audiogram in case the audiograms of the left and right ears are classified as EQUAL or SIMILAR) stored in memory unit F-MEM as inputs to determine appropriate frequency dependent gains for the user (the target gain values). The fitting algorithm may be a proprietary algorithm or a commercially available algorithm (e.g. NAL-RP or NAL-NL2 of the National Acoustic Laboratories, Australia). The resulting (target) gain values are uploaded to the hearing instrument(s) (HI-1, HI-2) via the programming interface (IF) and signal P-DATA for being stored in the memory unit and for use by the signal processing unit(s) (HA-DSP) of the respective hearing instrument(s). The programming unit (FIT-SYS) comprises appropriate input/output (KeyB) and display units allowing a person (e.g. an audiologist) to use the fitting software and to adapt the processing parameters, etc., of the hearing instrument(s) to a user's needs.

Figure 6A:
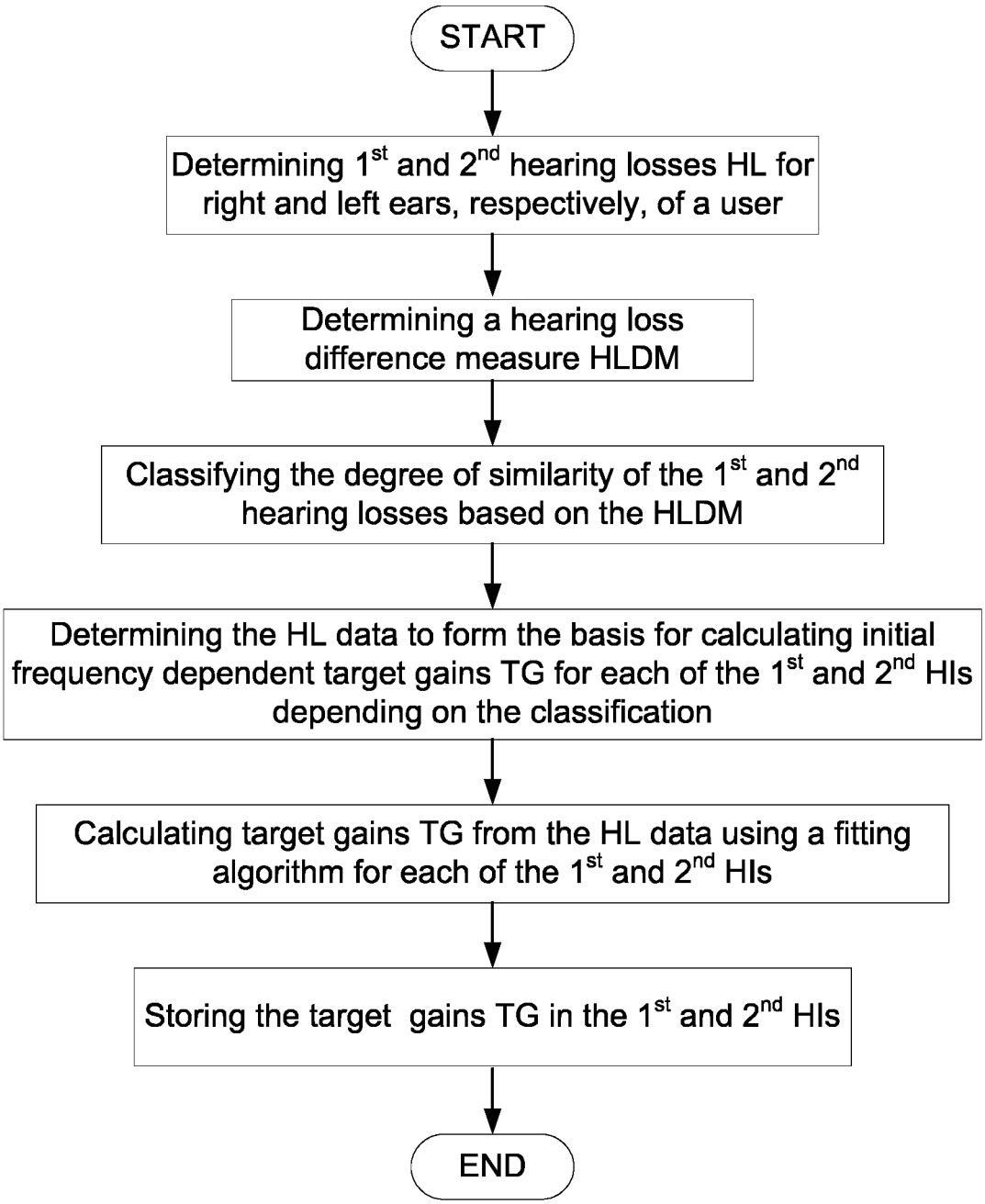
FIG. 6 shows flow diagrams of embodiments of a method of fitting a binaural hearing aid system to a user without (FIG. 6*a*) and with (FIG. 6*b*) subsequent modification of basic processing parameters over time.
Figure 6B:
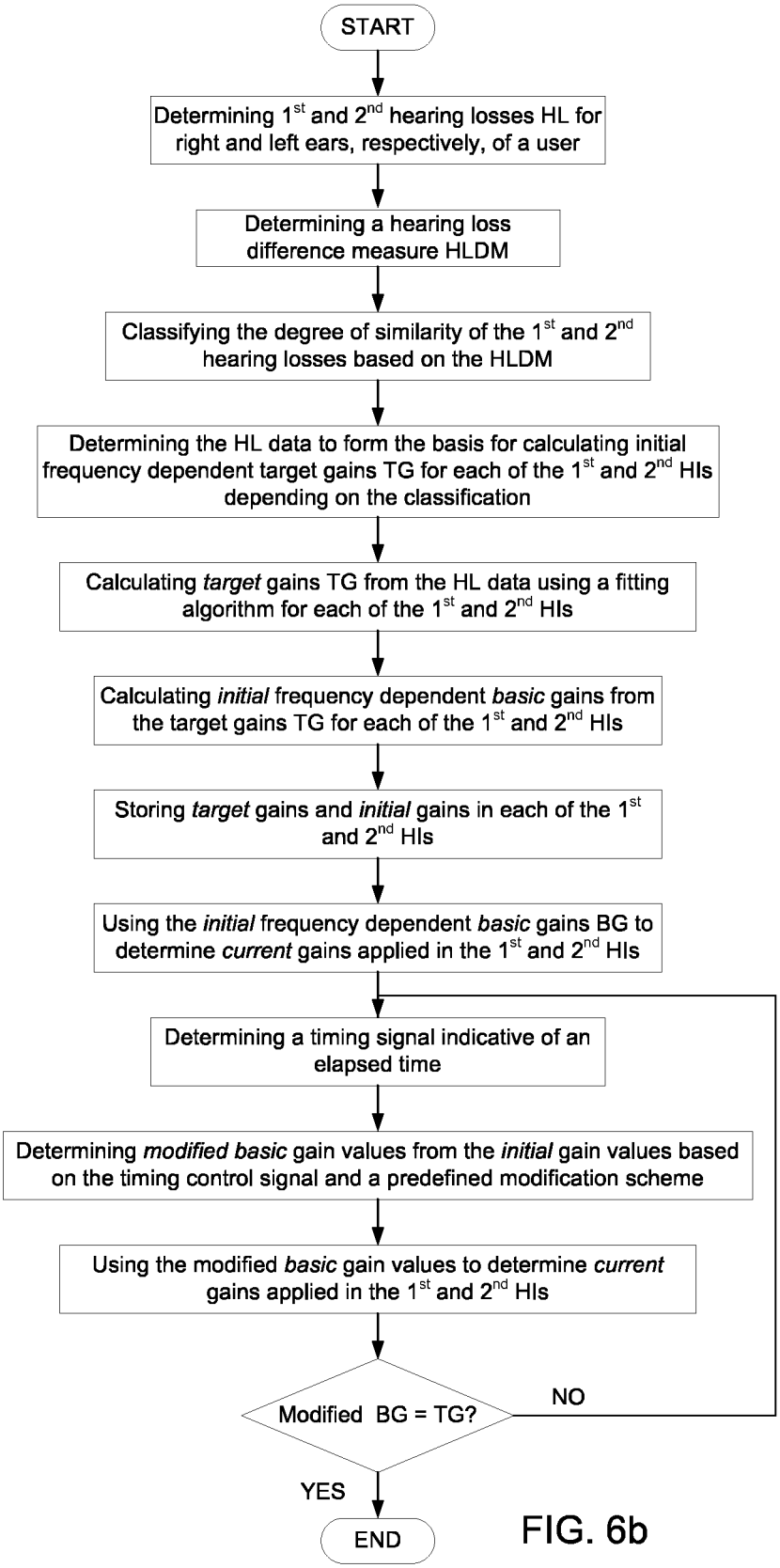

FIG. 6 shows flow diagrams of embodiments of a method of fitting a binaural hearing aid system to a user without (FIG. 6*a*) and with (FIG. 6*b*) subsequent modification of basic processing parameters over time.

FIG. 6*a* shows the basic steps of the method for calculating target gain values for a binaural hearing aid system aimed as outlined in the following:

Start.

S1: Determining $1^{st}$ and $2^{nd}$ hearing losses HL for right and left ears, respectively, of a user;

S2: Determining a hearing loss difference measure HLDM;

S3: Classifying the degree of similarity of the $1^{st}$ and $2^{nd}$ hearing losses based on the HLDM;

S4: Determining the HL data to form the basis for calculating initial frequency dependent target gains TG for each of the $1^{st}$ and $2^{nd}$ Hs depending on the classification;

S5: Calculating target gains TG from the HL data using a fitting algorithm for each of the $1^{st}$ and $2^{nd}$ Hls; and S6: Storing the target gains TG in the $1^{st}$ and $2^{nd}$ Hls.

End.

The hearing losses and target gains are determined or calculated as a function of frequency f, e.g. at a number of predetermined frequencies $f_i$.

In an embodiment, the method (e.g. step 1) comprises determining a conductive part (ABG(f)) of a hearing loss for the right and left ears, respectively, of a user. In an embodiment, the method is terminated, if the conductive part of the hearing loss for one or both ears of the user is larger than a predetermined amount (e.g. defined by an air-bone gap measure ABGM); and otherwise continued.

FIG. 6*b* shows an embodiment of the method wherein gain values are modified over time from an initial set to a target set of gain values. The method comprises an additional step S5*b* and slightly modified step S6 (S6*a*, S6*b*) (compared to the method illustrated in FIG. 6*a*) and the further steps S7-S10:

S1: Determining $1^{st}$ and $2^{nd}$ hearing losses HL for right and left ears, respectively, of a user;

S2: Determining a hearing loss difference measure HLDM;

S3: Classifying the degree of similarity of the $1^{st}$ and $2^{nd}$ hearing losses based on the HLDM;

S4: Determining the HL data to form the basis for calculating initial frequency dependent target gains TG for each of the $1^{st}$ and $2^{nd}$ Hls depending on the classification;

S5*a*: Calculating target gains TG from the HL data using a fitting algorithm for each of the $1^{st}$ and $2^{nd}$ Hls;

S5*b*: Calculating initial frequency dependent basic gains from the target gains TG for each of the $1^{st}$ and $2^{nd}$ Hls;

S6*a*: Storing the target gains TG and the initial basic gains in the $1^{st}$ and $2^{nd}$ Hls;

S6*b*: Using the initial frequency dependent basic gains BG to determine current gains applied in the $1^{st}$ and $2^{nd}$ Hls;

S7: Determining a timing signal indicative of an elapsed time;

S8: Determine modified basic gain values from the initial gain values based on the timing control signal and a predefined modification scheme;

S9: Using the modified basic gain values to determine current gains applied in the $1^{st}$ and $2^{nd}$ Hs;

S10: Question: Modified BG=TG?

If NO, go to step S7;

If YES, end procedure.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

References

[Schaub; 2008] Arthur Schaub, Digital hearing Aids, Thieme Medical. Pub., 2008.

WO2008109491A1 (AUDIOLOGY INC) Dec. 8, 2008.

The invention claimed is:

1. A method of fitting a binaural hearing aid system to a user by a hearing aid fitting system, the binaural hearing aid system comprising first and second hearing instruments adapted for being located at or in the right and left ear, respectively, of the user, the first and second hearing instruments being adapted to apply a frequency dependent gain to an input signal according to the user's hearing impairment, and for presenting an enhanced output signal to the user, the method comprising:

providing first hearing loss data for a right ear of the user to the hearing aid fitting system;

providing second hearing loss data for a left ear of the user to the hearing aid fitting system;

determining a hearing loss difference measure indicative of a difference between said first and second hearing loss data;

classifying a degree of similarity of the first and second hearing loss data based on said hearing loss difference measure into at least one of three different hearing loss classes EQUAL, SIMILAR and DIFFERENT;

determining basic hearing loss data to form the basis for calculating sets of frequency dependent target gain values for each of the first and second hearing instruments depending on said hearing loss classes, wherein said basic hearing loss data are identical for the first and second hearing instruments, if said hearing loss class is EQUAL or SIMILAR;

wherein said basic hearing loss data are different for the first and second hearing instruments, if said hearing loss class is DIFFERENT; and calculating the sets of frequency dependent target gain values for each of the first and second hearing instruments based on said basic hearing loss data.

2. A method according to claim 1 wherein hearing loss data for each ear of the user are recorded in a memory based on measurement of the user's hearing threshold at a number $N_{HL}$ of predetermined frequencies.

3. A method according to claim 1 wherein the hearing loss difference measure HLDM depends on the difference between the values of hearing losses of the first and second ears $HL_1(f)$-$HL_2(f)$ determined at a number $N_{HLDM}$ of frequencies.

4. A method according to claim 1, wherein the hearing loss difference measure HLDM is determined as a sum of said differences, $$HLDM_{SUM}=SUMi[|HL_1(f_i)-HL_2(f_i)|][dB],\ i=1-N_{HLDM},$$

where |x| denotes the absolute value of x, and SUMi[$x_i$] denotes a summation of elements $x_i$, for all i.

5. A method according to claim 2, wherein $N_{HL}$ and/or $N_{HLDM}$ are/is in the range from 2 to 10.

6. A method according to claim 1, wherein a criterion for classifying the degree of similarity of the first and second hearing losses comprises that the hearing loss difference measure HLDM is within predefined limits.

7. A method according to claim 4 wherein the first and second hearing losses are defined as being EQUAL if $HLDM_{SUM}$ is smaller than or equal to a first predefined threshold value $HLDM_{SUM,TH1}$ and DIFFERENT if $HLDM_{SUM}$ is larger than a second predefined threshold value $HLDM_{SUM,TH2}$, and SIMILAR if $HLDM_{SUM}$ is larger than the first predefined threshold value $HLDM_{SUM,TH1}$ but smaller than or equal to the second predefined threshold value $HLDM_{SUM,TH2}$.

8. A method according to claim 4 wherein the first and second hearing losses are defined as being EQUAL, if $(HLDM_{SUM}/N_{HLDM})\leq 12$ dB.

9. A method according to claim 4 wherein the first and second hearing losses are defined as being SIMILAR, if 12 dB$<(HLDM_{SUM}/N_{HLDM})\leq 20$ dB.

10. A method according to claim 4 wherein the first and second hearing losses are defined as being DIFFERENT if $(HLDM_{SUM}/N_{HLDM})>20$ dB.

11. A method according to claim 1 wherein the basic hearing loss data for the hearing loss class EQUAL used in the calculation of target gain values in the first and second hearing instruments are determined as the value MIN$\{HL_1(f_i); HL_2(f_i)\}$, where MIN denotes the minimum function, $HL_1(f_i)$ and $HL_2(f_i)$ are the hearing loss values at the $i^{th}$ frequency $f_i$ for the first (right) and second (left) ears, respectively, of the user, and i=1, 2, . . . , $N_{HL}$.

12. A method according to claim 1 wherein the basic hearing loss data for the hearing loss class SIMILAR used in the calculation of target gain values in the first and second hearing instruments are determined as the value MIN$\{HL_1(f_i); HL_2(f_i)\}+(1/3)|HL_1(f_i)-HL_2(f_i)|$, where MIN denotes the minimum function, $HL_1(f_i)$ and $HL_2(f_i)$ are the hearing loss values at the $i^{th}$ frequency $f_i$ for the first (right) and second (left) ears, respectively, of the user, i=1, 2, . . . , $N_{HL}$, and |x| denotes the absolute value of x.

13. A method according to claim 1 wherein the hearing loss data for the hearing loss class DIFFERENT used in the calculation of target values in the first and second hearing instruments are the respective relevant hearing loss data $HL_1(f_i)$ and $HL_2(f_i)$, i=1, 2, . . . , $N_{HL}$ for the first and second ears, respectively.

14. A method according to claim 1, further comprising storing said sets of frequency dependent target gain values, or gain values originating therefrom, for each of the first and second hearing instruments in the first and second hearing instruments, respectively.

15. A method according to claim 1 wherein the hearing loss data to form the basis for calculating sets of frequency dependent target gain values for the two hearing instruments of a binaural hearing aid system by classifying the similarity of audiograms for the left and right ears of the user are based on air conduction hearing loss data ($AC_{HL}(f)$).

16. A method according to claim 1 wherein a conductive hearing loss ABG(f) is determined for the left and right ears of the user and the method comprises identifying conductive hearing losses smaller than a predefined value represented by an ABG-measure.

17. A method according to claim 1 wherein the classification of the hearing loss difference between the right and left ears is used to determine the time development of the gain values in the left and right hearing instruments from initial gain values to the target gain values.

18. A method according to claim 17 wherein a rate of change of initial gains towards target gains is controlled in dependence of the classification of the hearing loss difference.

19. A method according to claim 18 wherein the rate of change of initial gains towards target gains is slower the larger the hearing loss difference between the right and left ears.

20. A binaural hearing aid system comprising first and second hearing instruments adapted for being located at or in the right and left ear, respectively, of a user, the first and second hearing instruments each comprising:

an input transducer for providing an electric input signal representing an audio signal;

an output transducer for converting a processed electric signal to a stimulus perceivable as sound to the user;

a forward path being defined between the input and output transducers, the forward path comprising a signal processing unit being adapted to apply time and frequency dependent gain values to an input signal according to the user's hearing impairment;

a memory unit comprising a set of target gain values for the respective hearing instrument;

a programming interface to a hearing aid fitting system for exchanging data between said fitting system and the binaural hearing aid system, wherein said target gain values are determined by a method including providing first hearing loss data for a right ear of the user;

providing second hearing loss data for a left ear of the user;

determining a hearing loss difference measure indicative of a difference between said first and second hearing loss data;

classifying a degree of similarity of the first and second hearing loss data based on said hearing loss difference measure into at least one of three different hearing loss classes EQUAL, SIMILAR and DIFFERENT;

determining basic hearing loss data to form the basis for calculating sets of frequency dependent target gain values for each of the first and second hearing instruments depending on said hearing loss classes, wherein said basic hearing loss data are identical for the first and second hearing instruments, if said hearing loss class is EQUAL or SIMILAR;

wherein said basic hearing loss data are different for the first and second hearing instruments, if said hearing loss class is DIFFERENT; and calculating the sets of frequency dependent target gain values for each of the first and second hearing instruments based on said basic hearing loss data, and said target gain values are transferred to the memory units of the respective first and second hearing instruments of the binaural hearing aid system via said programming interface.

21. A binaural hearing aid system according to claim 20 wherein each of the first and hearing instruments comprise an antenna and transceiver circuitry for wirelessly receiving a direct electric input signal from another device.

22. A hearing aid fitting system, comprising:

a processor configured to perform the a method of fitting a binaural hearing aid system to a user; and a programming interface to the binaural hearing aid system, wherein the method of fitting the binaural hearing aid system includes providing first hearing loss data for a right ear of the user;

providing second hearing loss data for a left ear of the user;

determining a hearing loss difference measure indicative of a difference between said first and second hearing loss data;

classifying a degree of similarity of the first and second hearing loss data based on said hearing loss difference measure into at least one of three different hearing loss classes EQUAL, SIMILAR and DIFFERENT;

determining basic hearing loss data to form the basis for calculating sets of frequency dependent target gain values for each of the first and second hearing instruments depending on said hearing loss classes, wherein said basic hearing loss data are identical for the first and second hearing instruments, if said hearing loss class is EQUAL or SIMILAR;

wherein said basic hearing loss data are different for the first and second hearing instruments, if said hearing loss class is DIFFERENT; and calculating the sets of frequency dependent target gain values for each of the first and second hearing instruments based on said basic hearing loss data.

23. The hearing aid fitting system according to claim 22 configured to adapt parameters of the first and second hearing instruments of the binaural hearing aid system to the needs of the particular user.

24. The binaural hearing aid system according to claim 21, wherein said another device is a communication device or another hearing instrument.

25. The method according to claim 1, further comprising:

transmitting the sets of frequency dependent target gain values to at least one of the first and second hearing instruments over a programming interface between the binaural hearing aid system and the hearing aid fitting system.

* * * * *